US008123381B1

(12) United States Patent
Wray

(10) Patent No.: US 8,123,381 B1
(45) Date of Patent: Feb. 28, 2012

(54) LED LIGHTING SYSTEMS AND METHODS USEABLE FOR REPLACEMENT OF UNDERWATER NICHE LIGHTS AND OTHER APPLICATIONS

(75) Inventor: Donald Lee Wray, Ocala, FL (US)

(73) Assignee: J&J Electronics, Inc., Irvine, CA (US)

( * ) Notice: Subject to any disclaimer, the term of this patent is extended or adjusted under 35 U.S.C. 154(b) by 0 days.

(21) Appl. No.: 12/206,619

(22) Filed: Sep. 8, 2008

Related U.S. Application Data

(60) Provisional application No. 60/970,847, filed on Sep. 7, 2007, provisional application No. 60/979,291, filed on Oct. 11, 2007.

(51) Int. Cl.
*F21V 29/00* (2006.01)

(52) U.S. Cl. ..... 362/294; 362/373

(58) Field of Classification Search ..... 362/294, 362/373, 640, 649, 650, 647, 646, 547–549, 362/545, 249.02, 345
See application file for complete search history.

(56) References Cited

U.S. PATENT DOCUMENTS

| | | | | |
|---|---|---|---|---|
| 4,539,629 | A * | 9/1985 | Poppenheimer | 362/267 |
| 5,806,965 | A * | 9/1998 | Deese | 362/249.04 |
| 5,842,771 | A * | 12/1998 | Thrasher et al. | 362/101 |
| 6,357,893 | B1 * | 3/2002 | Belliveau | 362/285 |
| 6,902,291 | B2 * | 6/2005 | Rizkin et al. | 362/153.1 |
| 2005/0111234 | A1 * | 5/2005 | Martin et al. | 362/555 |
| 2005/0174780 | A1 * | 8/2005 | Park | 362/294 |
| 2006/0193139 | A1 * | 8/2006 | Sun et al. | 362/373 |
| 2008/0123341 | A1 * | 5/2008 | Chiu | 362/294 |

* cited by examiner

*Primary Examiner* — Julie Shallenberger

(74) *Attorney, Agent, or Firm* — Robert D. Buyan; Stout, Uxa, Buyan & Mullins, LLP

(57) ABSTRACT

Light emitting diode lighting systems and methods useable to replace incandescent bulbs or other types of LED light sources in enclosed environments, such as in underwater lighting niches used in swimming pool, spa, fountain and other underwater lighting applications.

7 Claims, 9 Drawing Sheets

LED LIGHTING SYSTEMS AND METHODS USEABLE FOR REPLACEMENT OF UNDERWATER NICHE LIGHTS AND OTHER APPLICATIONS

RELATED APPLICATIONS

This patent application claims priority to U.S. Provisional Patent Application Nos. 60/970,847 filed Sep. 7, 2007 and 60/979,291 filed Oct. 11, 2007, the entire disclosures of which are expressly incorporated herein by reference.

FIELD OF THE INVENTION

The present invention relates to light emitting diode (LED) lamps useable in underwater lighting applications for swimming pools and the like and to the replacement of existing incandescent light bulbs with LED light sources in underwater lighting applications for swimming pools and the like.

BACKGROUND OF THE INVENTION

Swimming pools and spas often have lights which are located below the water level to illuminate water within the pool or spa. This is typically accomplished by mounting a light bulb within a fixture that is located in a water-tight cavity known as a "niche" formed in the wall of the pool or spa. The watertight cavity or niche typically has an outer lens that prevents water from entering the fixture or niche.

In many existing swimming pools and spas, incandescent light bulbs are mounted within the niches. In recent years it has become known to replace those existing incandescent light bulbs with LED light sources in order to conserve power, provide varied colors of light and/or obtain greater light intensity.

For example, U.S. Pat. No. 6,184,628 (Ruthenberg) describes the use of predetermined arrays of a plurality of different colored LED bulbs to replace an incandescent pool light where the plurality of different colored LED bulbs are wired in such a manner that the predetermined arrays of plurality of different colored LED bulbs activate at predetermined sequences for predetermined time intervals wherein the bulbs are encased in a lens. Even though LED bulbs are used, providing LED lighting fixtures with brightness to rival incandescent bulbs is still an issue, especially when not all of the LED bulbs are illuminated, as suggested in the '628 patent.

United States Patent Application Publication Nos. 20030048632 (Archer) entitled "Light Emitting Diode Pool Assembly" and 2004/0223320 (Archer et al.) entitled "Nicheless Pool Light System" describe an LED light assembly that has a reflective plate with a plurality of perforations formed through the reflective plate. LED bulbs protrude through the perforations in the reflective plate. A control circuit is selectively operable to produce light in a plurality of colors through the LED bulbs. The control circuit comprises a switch that, when activated a defined number of times, produces a plurality of at least light colors and light patterns, wherein each of the plurality of at least light colors and light patterns are selected based on the defined number of times the switch is activated.

United States Patent Application Publication No. 20070159833 (Netzel et al.) entitled "LED Pool and Spa Light" describes a lighting fixture that includes a heat sink having a first mounting portion attached to a housing. A first circuit board containing LEDs is mounted to a first side of a second mounting portion of the heat sink. A second circuit board include an LED control circuit is mounted to a second side of the second mounting portion. A multi-layer circuit board includes a heat-dissipating core bonded to first and second dielectric substrates, which are bonded to first and second electrically conductive layers. An electrical conductor extends through a through-hole in the board to electrically connect the first and second conductive layers. An electrical insulator inside the through-hole electrically isolates the core from the conductor. A transparent cover is shaped to cause downwardly projecting light rays emitted from the LEDs to be refracted more than upwardly projecting light rays. The cover also includes vertically extending projections for horizontally refracting light.

United States Patent Application Publication No. 20060187652 (Doyle) entitled "LED Pool or Spa Light Having Unitary Lens Body" describes a light emitting diode pool or spa lamp bulb having at least one light emitting diode with at least one lens body that is optically clear. The light emitting diode(s) is/are embedded in the lens body and the lens body is in direct contact with the water within the pool or spa.

However, the use of LED light sources to replace incandescent lights in swimming pool and spa underwater fixtures and niches has been subject to certain limitations and difficulties. For example, because LED's produce substantial amounts of heat, the power of the LED's used in the replacement light source has, in at least some applications, been limited by the tendency for heat to collect within the watertight fixture or niche. Also, in at least some applications, when a plurality of LED's cast light though an existing lens positioned over the water-tight fixture or niche, a plurality of light columns or spots are projected through the water instead of a desired diffuse distribution of light through the pool water. Thus, there remains a need in the art for the development of new LED lighting systems which may be used to replace existing incandescent or LED light sources in swimming pool and spa light fixtures and niches.

SUMMARY OF THE INVENTION

The present invention provides improved LED lighting systems and methods which may be used in a variety of applications, such as replacement of existing LED light sources or incandescent light bulbs within lighting fixtures or niches of the type used in swimming pool, spa, fountain and other underwater applications.

In accordance with the present invention, there is provided an LED lighting system that is useable to replace an existing LED or non-LED light source in a niche (such as an underwater niche) that has an existing lens through which light passes, but wherein the existing lens will cause an undesired optical effect (e.g., causing the light to project in discrete columns or spots) on light that passes through that lens from the replacement LED light source. This LED lighting system generally comprises (A) at least one LED, (B) a circuit board connected to the LED(s) for driving the LED(s) and (C) a corrective apparatus, such as a corrective lens (e.g., a diffuser or holographic diffuser), constructed to prevent, counteract or correct the undesired optical effect of the existing niche lens.

Further in accordance with the invention, there is provided an LED lighting system that comprises (A) a housing; (B) at least one LED; (C) at least one circuit board connected to the LED for driving the LED; and (D) an air moving device (e.g., a fan) for cooling the LED(s) and/or the circuit board(s). One or more flow-through openings (e.g., holes or open vias) may be formed in the circuit board such that the air moving device may cause air to flow therethrough. Also, one or more inflow opening(s) and one or more outflow opening(s) may be formed in the housing (or on a lens affixed to the front of the housing) so that the air moving device can draw air into, and exhaust air out of, the interior of the housing.

Still further in accordance with the invention, there is provided an LED lighting system that that is useable to replace an existing LED or non-LED light source in a niche (e.g., an underwater niche) that has an existing niche lens that is constructed such that it will cause an undesired optical effect (e.g., causing the light to project in discrete columns or spots) on light that passes through that existing niche lens from the replacement LED light source (e.g., causing the light to project in discrete columns or spots). This LED lighting system generally comprises (A) a housing; (B) at least one LED; (C) at least one circuit board connected to the LED for driving the LED; (D) an air moving device (e.g., a fan) for cooling the LED(s) and/or the circuit board(s) and (E) a corrective apparatus, such as a corrective lens (e.g., a diffuser or holographic diffuser), constructed to prevent, counteract or correct the undesired optical effect of the existing niche lens.

Still further in accordance with the present invention, there are provided methods for using the LED lighting systems of the foregoing character to replace existing LED light sources or existing incandescent light bulbs in niches (e.g., underwater niches), such as those used in swimming pool, spa, fountain and other underwater applications.

Further aspects, elements, objects, details and examples of the devices and methods of the present inventions will be understood by those of skill in the art upon reading of the detailed description and examples set forth herebelow.

DETAILED DESCRIPTION AND EXAMPLES

The following detailed description and the accompanying drawings to which it refers are intended to describe some, but not necessarily all, examples or embodiments of the invention. The described embodiments are to be considered in all respects only as illustrative and not restrictive. The contents of this detailed description and the accompanying drawings do not limit the scope of the invention in any way.

Figure 1:
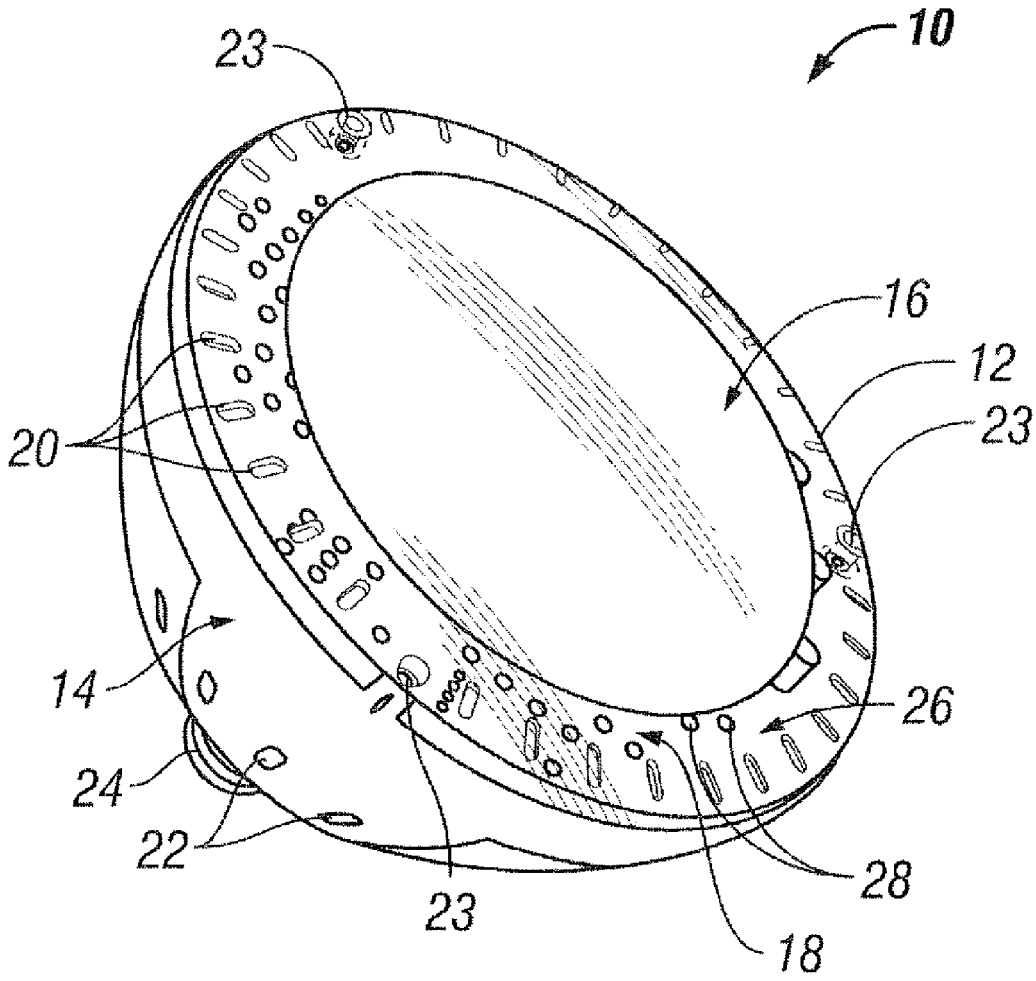
FIG. 1 is a perspective view of one embodiment of an LED lamp of the present invention.
Figure 2:
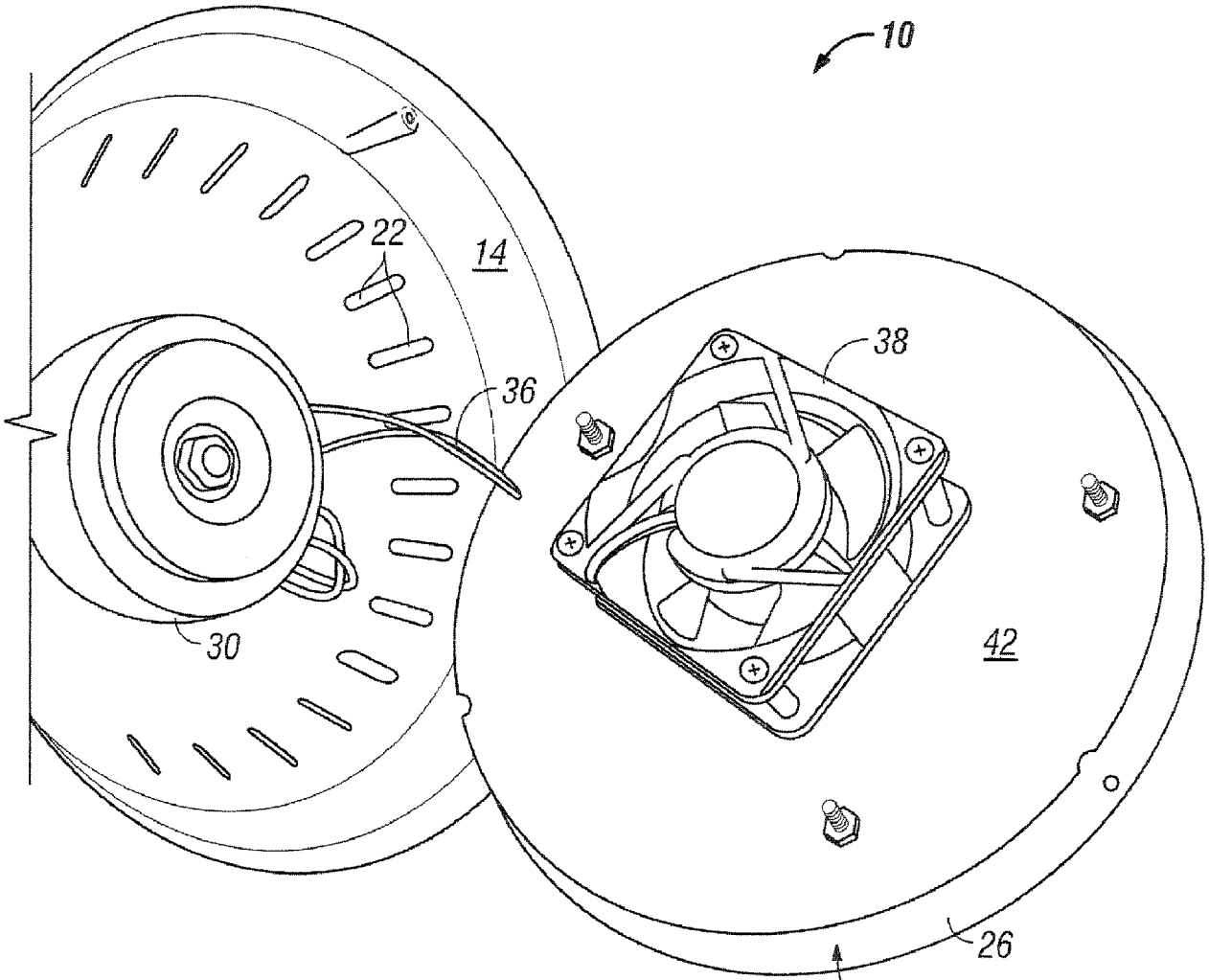
FIG. 2 is an exploded perspective view of the LED lamp of FIG. 1.
Figure 3:
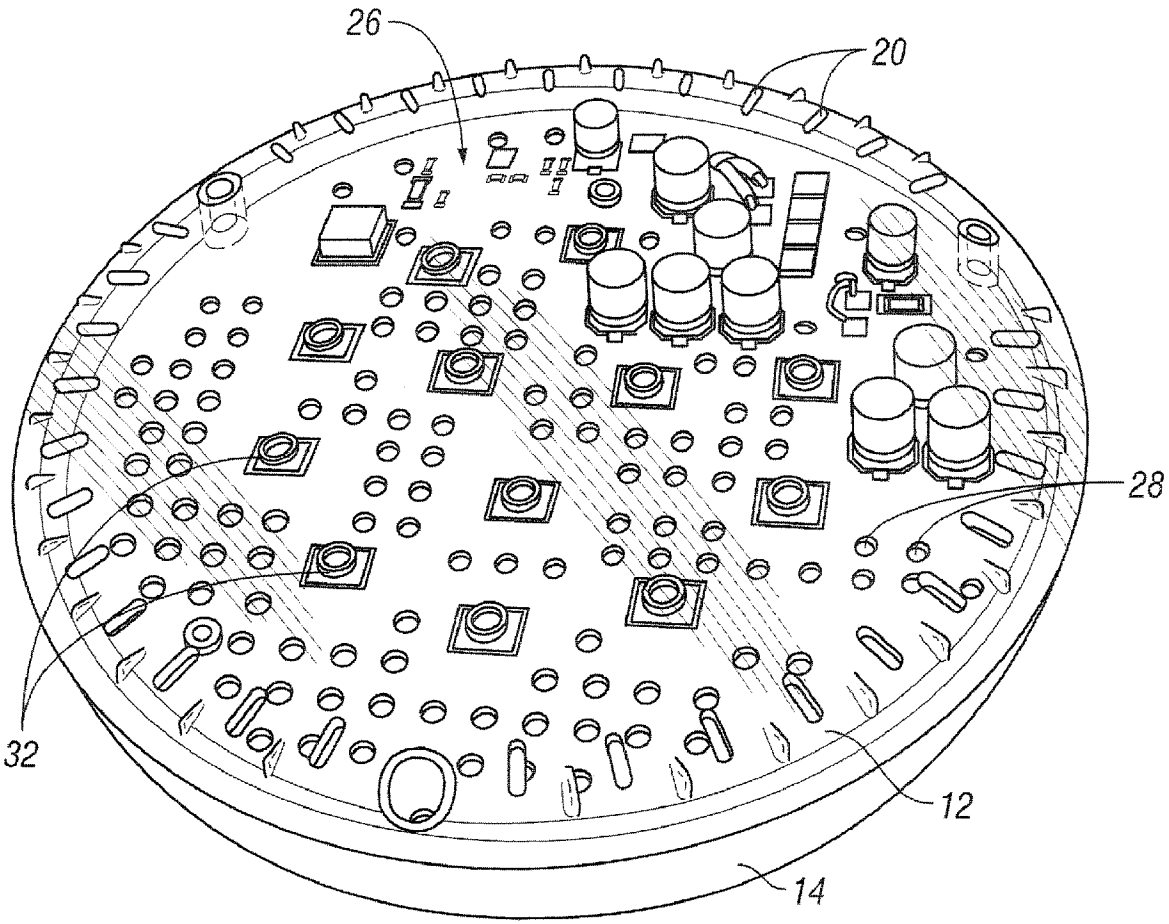
FIG. 3 is a front perspective view of the LED lamp of FIG. 1 wherein components on the front surface of the lamp's circuit board are visible through the transparent front lens of the lamp.

FIGS. 1 through 3 show one example of an LED system 10 of the present invention which may be used, in some applications, to replace an existing LED light source or incandescent light bulb within a niche (e.g., an underwater niche) of the type used in swimming pool, spa, fountain and other underwater applications. This system 10 generally comprises a lens 12 mounted on the front of a concave housing 14. The lens 12 optionally has a central corrective region 16 surrounded a clear or non-corrective peripheral region 18. Air inflow openings 20 are formed at spaced apart locations around the periphery of the lens 16, as shown. Air outflow openings 22 are formed at spaced-apart locations around the housing 14, as shown. Those of skill in the art will understand that the air inflow openings 20 and air outflow openings 22 could alternatively be formed at locations other than those shown in this example.

Within the housing 14, behind the lens 12, is an LED driver printed circuit board (PCB) 26 having an LED driver circuit (diagramed in FIG. 5) and a plurality of LED's 32 mounted thereon. In embodiments where the lens 16 includes the optional corrective region 16, the LED's 32 may be positioned behind the optional corrective region 16 of the lens 12 so that light cast from the LEDs will pass through the corrective region 16 of the lens 12. Flow-through openings 28 are formed in the LED driver printed circuit board (PCB) assembly 26 to allow air to pass through the circuit board 26. In the particular embodiment shown, each flow-through opening 28 is approximately 0.25 inches in diameter, although other sizes and shapes of openings may alternatively be used. Also, in the particular embodiment shown, the LED's may comprise either 12, 2.5 W Cree XR-E series white LED's for a white swimming pool light or 14 red-green-blue (RGB) LEDs (e.g., 6 Red, 4 Green and 4 Blue Cree XR and XR-E series LEDs) for a RGB pool light, along with a low dropout analog LED driver circuit.

A fan controller PCB 42 is mounted a spaced distance behind the LED driver printed circuit board (PCB) assembly 26 and a fan 38 is attached to the back side of the fan controller PCB assembly 42. An open space 44 which functions as a low pressure air plenum exists between the LED driver printed circuit board (PCB) assembly 26 and the fan controller PCB assembly 42. One or more opening(s), such as a central opening 43 located in front of the fan 38, may be formed in the fan controller PCB 42 to allow the fan 38 to draw air from the open space 44 which functions as a low pressure air plenum.

A transformer 30, such as a 120 volt AC to 14 volt AC toroidal transformer, is mounted within the housing 14 beneath the fan 38. The fan 38 and LEDs 32 are connected to and powered by the transformer 30.

Figure 4:
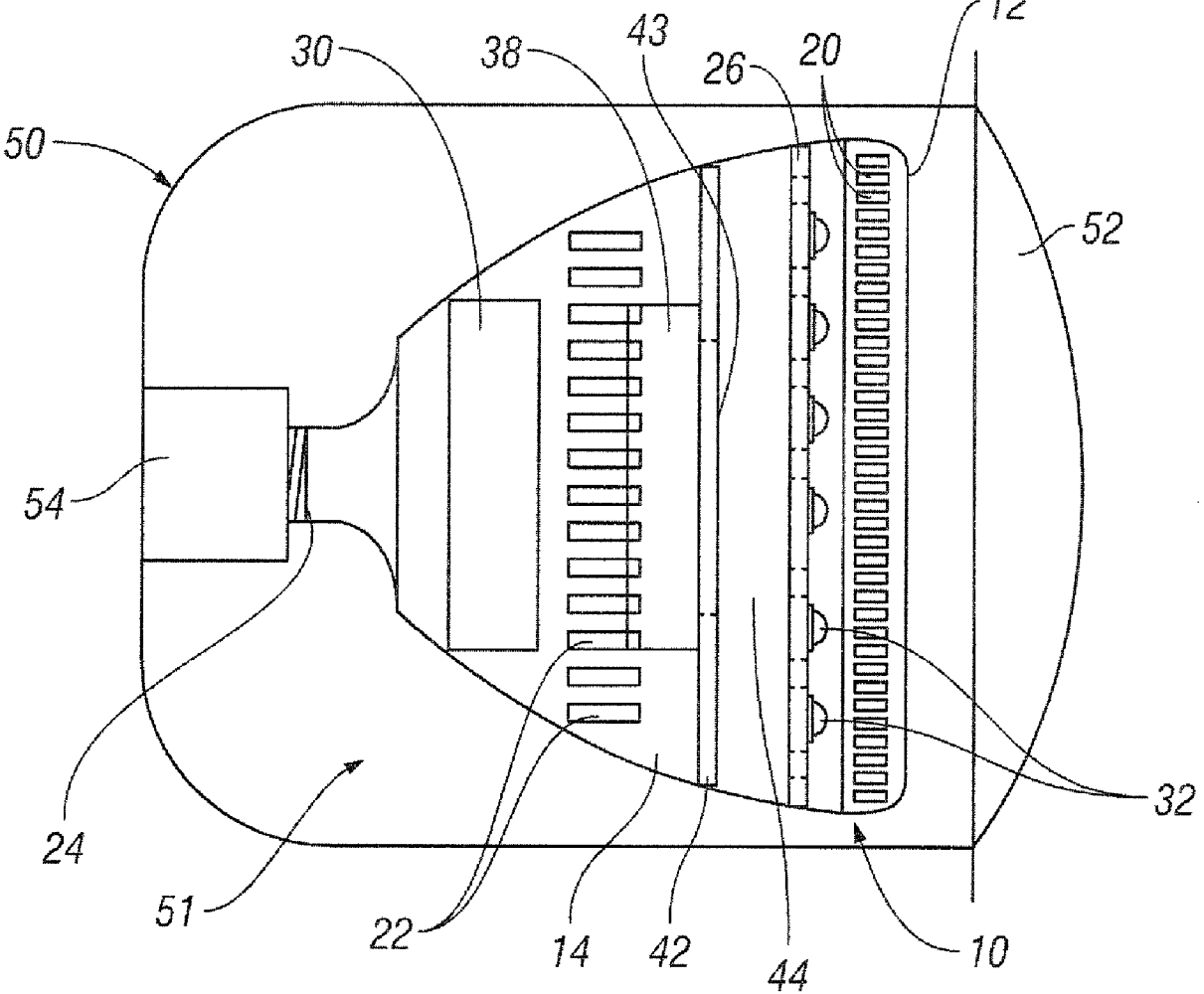
FIG. 4 is a schematic diagram showing an LED lamp of the present invention mounted within a swimming pool light niche.

FIG. 4 shows the manner in which the LED lighting system 10 of FIGS. 1-3 may be used to replace an existing LED light source or incandescent bulb within a niche (e.g., an underwater niche). In this example, the niche 50 comprises a concave space 51 formed within a wall (e.g., the side wall of a swimming pool, spa, fountain or other water containing structure). A water tight lens 52 is mounted on the front of the niche 51. A female light bulb receptacle 54 is positioned within the base of the niche 50. The niche lens 52 is initially removed and the existing LED light source or bulb is unscrewed and removed from the female light bulb receptacle 54. The threaded contact base 24 of the LED light system 10 of this invention is screwed into the female light bulb receptacle 54 within the niche 50 and the niche lens 52 is again attached to the front of the niche 50. When energized, current is received by the transformer 30, the LEDs 32 are illuminate and the fan 38 begins to run. The running fan 38 pulls air inwardly from the niche's concave internal space 51, through inlet openings 20, through the plurality of flow-though openings 28 in the LED circuit board 26, through the central opening 43 of the fan driver PCB 42 and outwardly through the air outflow openings 22 and back into the interior space 51 of the niche 50. In this manner, heat is continually dissipated from the LEDs 32 and is distributed throughout the interior space 51 of the niche 50.

The device may be specifically configured to facilitate a circulating flow or air over the LED(s) 32 to remove heat from the LED(s) 32. The novel cooling capability of this system 10 allows high power LED(s) to be used without problems due to heat build up. Additionally, LED lighting assemblies of this invention may be used to replace low power LEDs or non-LED light sources (e.g., incandescent light bulbs) in pre-existing fixtures or niches such as swimming pool light niches.

In at least some cases, such as where the niche lens 52 was originally designed for use with an incandescent bulb, the passage of light from the individual LED's 32 through the niche lens 52 may result in undesirable effects on the projected light, such as separation of the light into individual columns resulting in a plurality of individual spots of light rather than casting of diffuse light throughout the water. To remedy this, the lens 12 of the LED lighting system 10 may incorporate the optional corrective region 16 which is optically designed to prevent, counteract or correct the undesired optical effect of the existing niche lens 52. For example, when the LED lighting system 10 is used to replace an incandescent light bulb in a typical swimming pool niche light, the corrective region 16 of the lens 12 may comprise a polycarbonate holographic light shaping diffuser for homogenized light, available commercially from Luminit, 20600 Gramercy Place, Bldg. 203, Torrance, Calif. 90501-1821.

Figure 5:
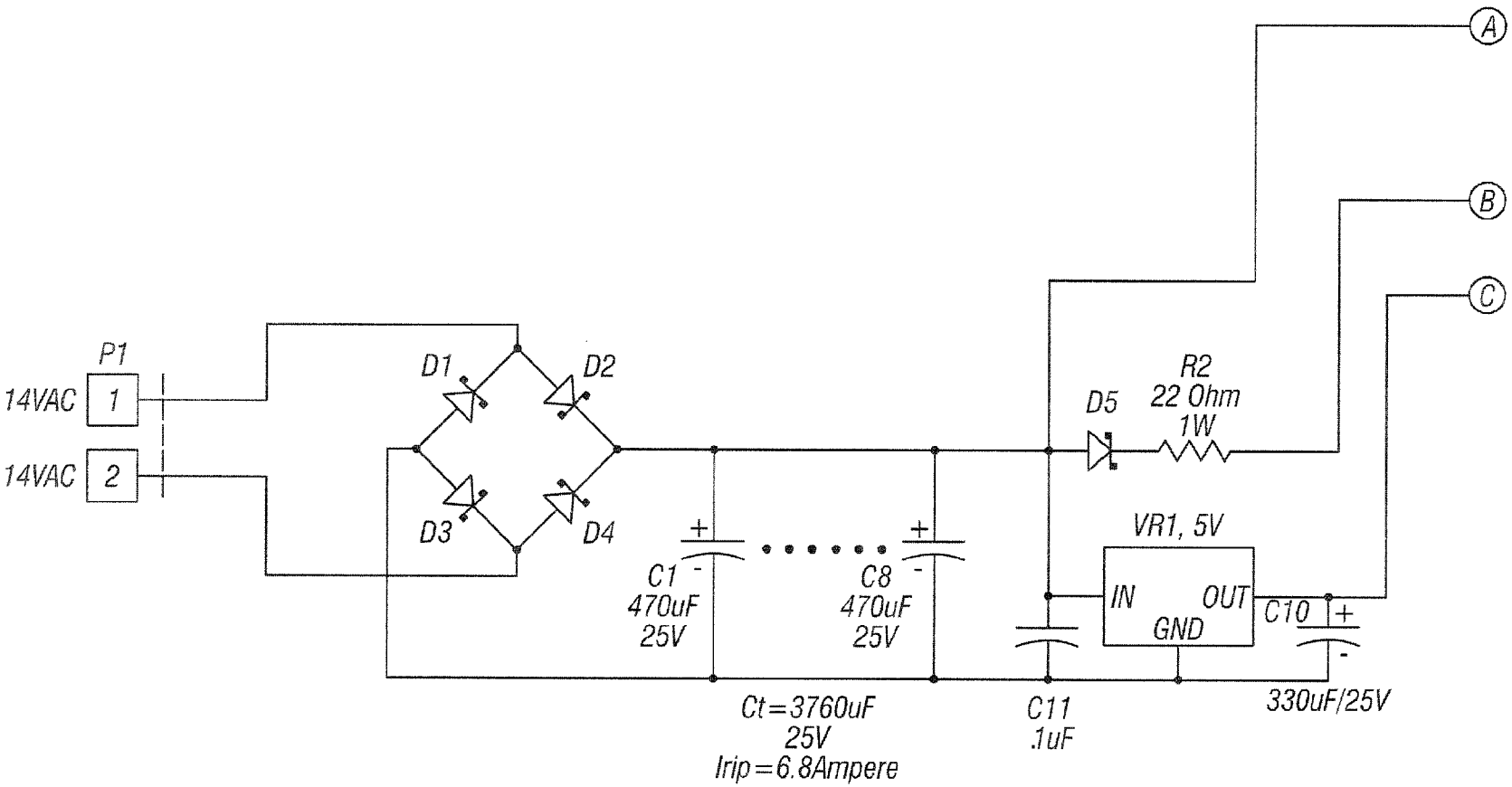
FIG. 5 is one example of a driver circuit diagram for a white LED system of FIG. 1.
Figure 5:
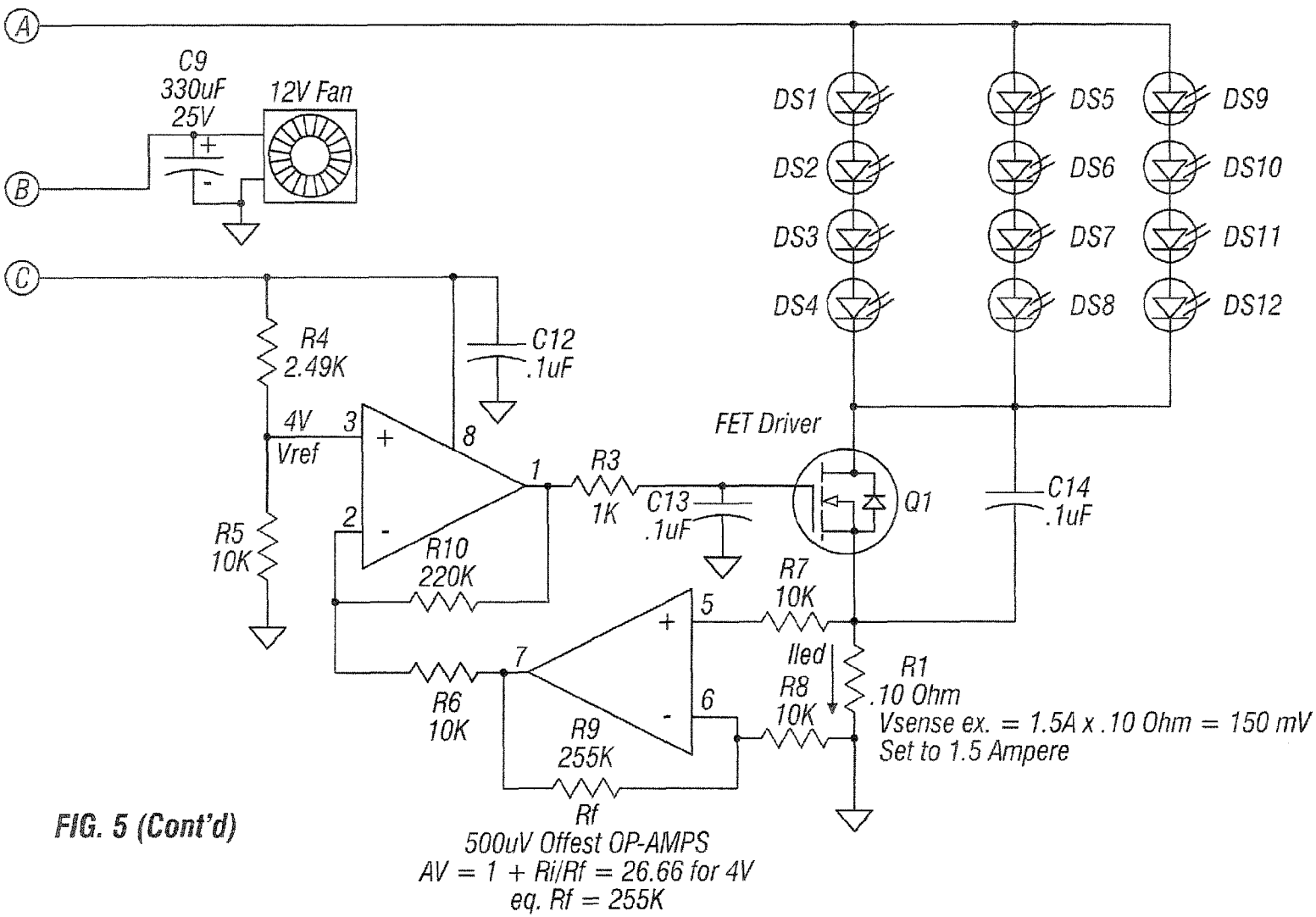

FIG. 5 shows one non-limiting example of a type of LED driver circuit that may be provided on the LED driver PCB 26 in a typical white swimming pool light of the present invention. The specific components of this circuit are described in U.S. Provisional Patent Application Nos. 60/970,847 filed Sep. 7, 2007 and 60/979,291 filed Oct. 11, 2007, the entire disclosures of which are expressly incorporated herein by reference.

Figure 6:
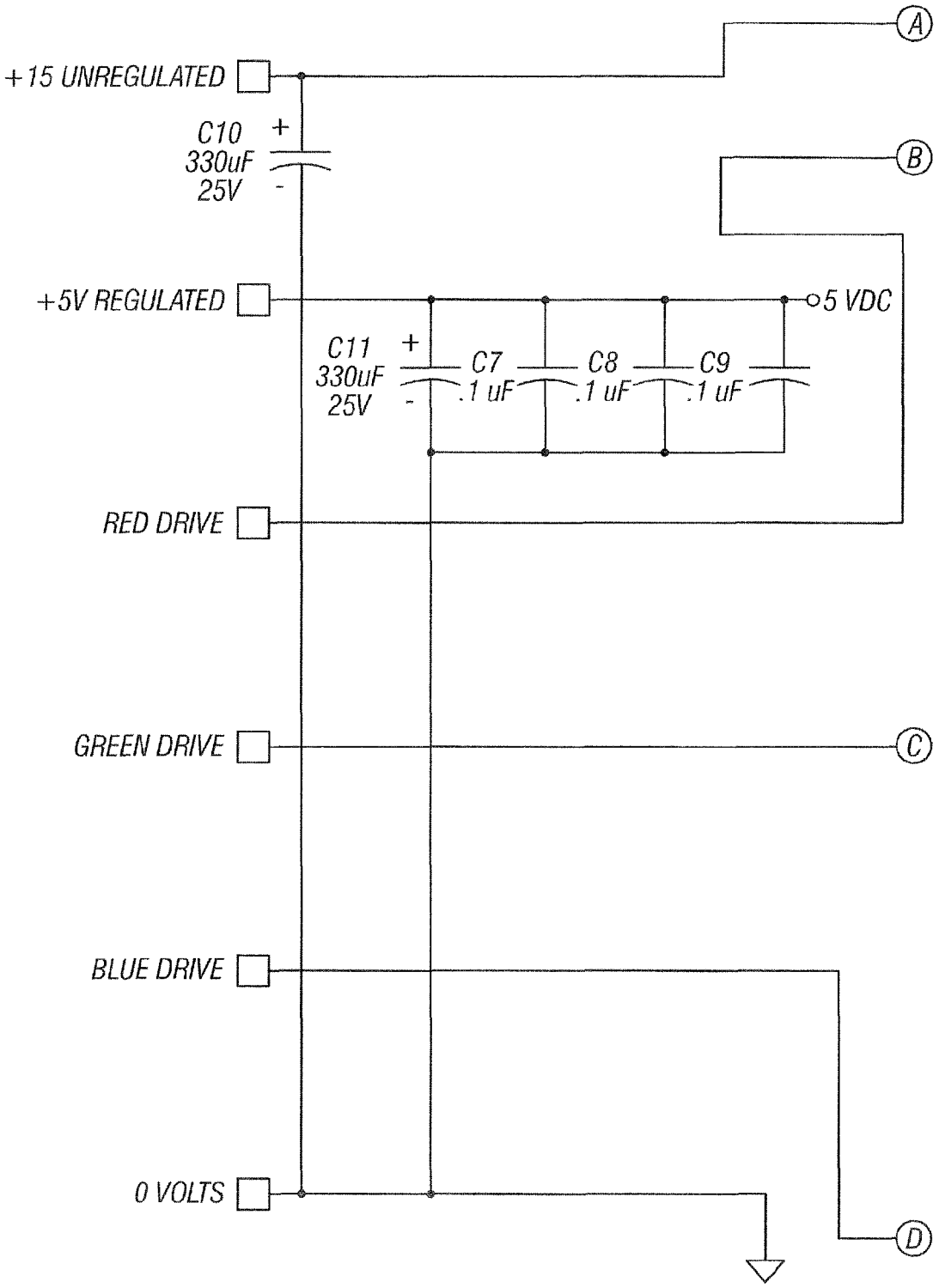
FIG. 6 is one example of a driver circuit diagram for an RGB LED system of FIG. 1.
Figure 6:
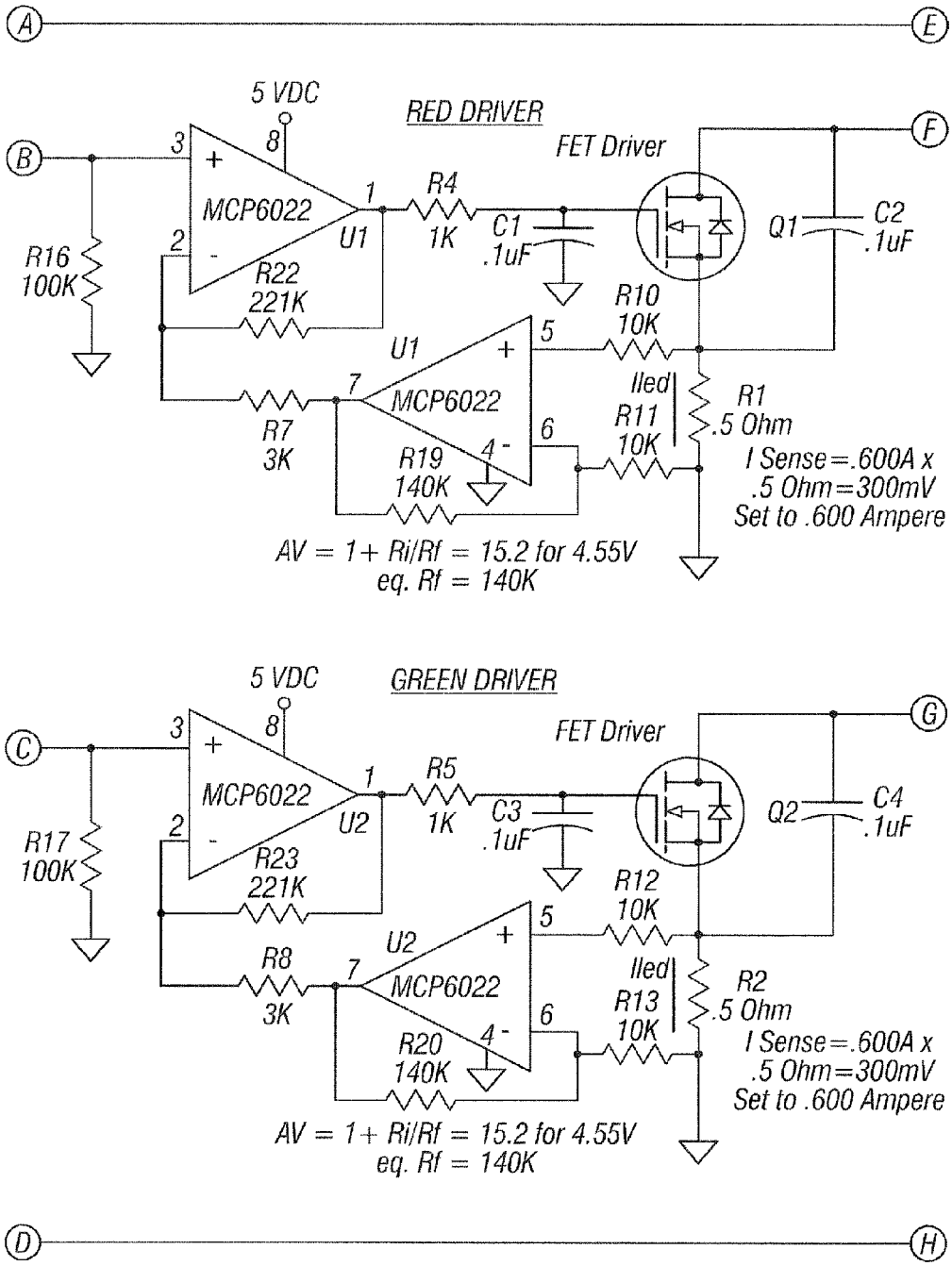
Figure 6:
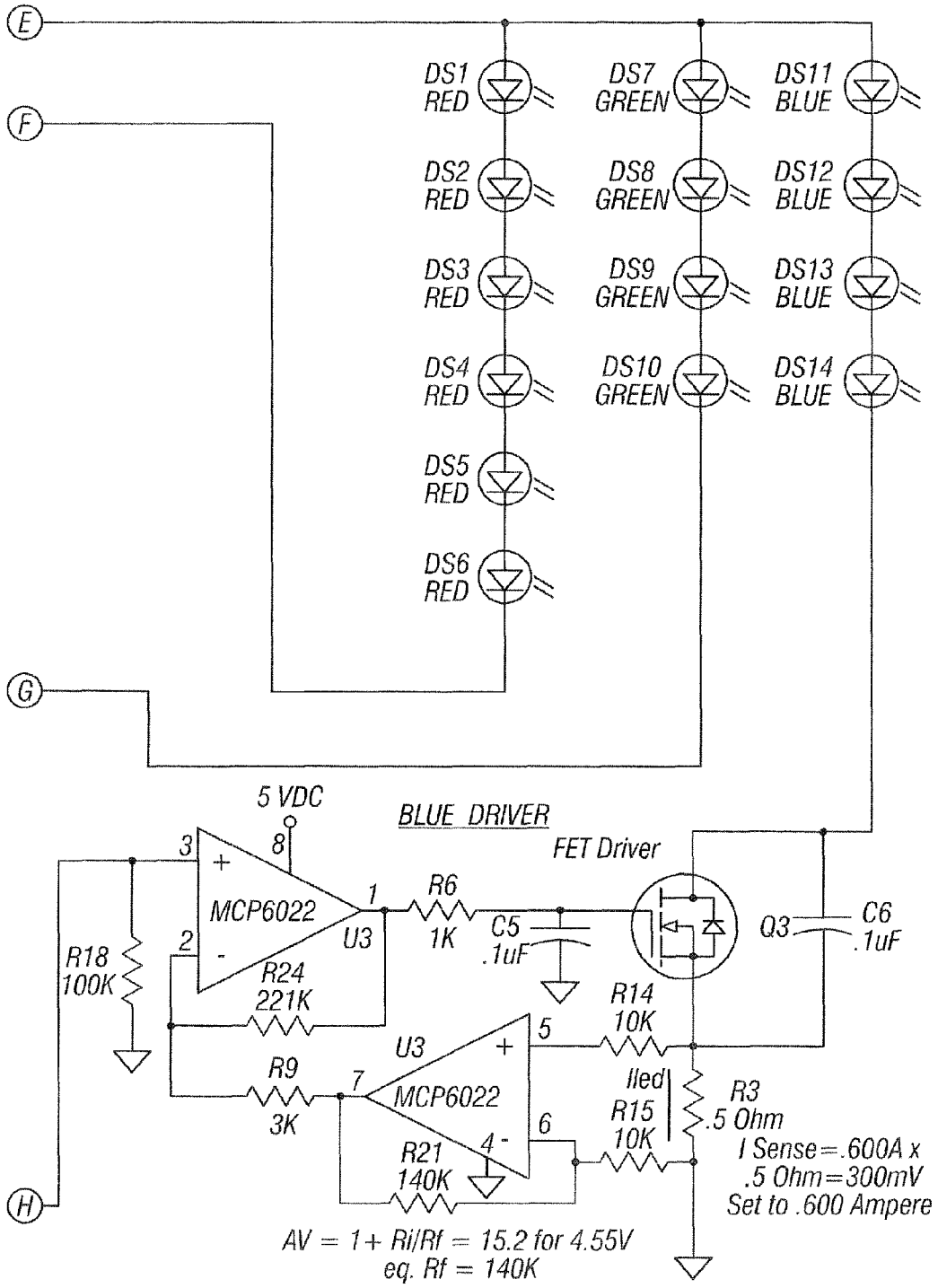

FIG. 6 shows one non-limiting example of a type of LED driver circuit that may be provided on the LED driver PCB 26 in a typical RGB swimming pool light of the present invention. The specific components of this circuit are described in U.S. Provisional Patent Application Nos. 60/970,847 filed Sep. 7, 2007 and 60/979,291 filed Oct. 11, 2007, the entire disclosures of which are expressly incorporated herein by reference.

It is to be appreciated that the invention has been described hereabove with reference to certain examples or embodiments of the invention but that various additions, deletions, alterations and modifications may be made to those examples and embodiments without departing from the intended spirit and scope of the invention. For example, any element or attribute of one embodiment or example may be incorporated into or used with another embodiment or example, unless otherwise specified of if to do so would render the embodiment or example unsuitable for its intended use. Also, where the steps of a method or process have been described or listed in a particular order, the order of such steps may be changed unless otherwise specified or unless doing so would render the method or process unworkable for its intended purpose. All reasonable additions, deletions, modifications and alterations are to be considered equivalents of the described examples and embodiments and are to be included within the scope of the following claims.

What is claimed is:

1. An LED lighting system positionable in a niche that has a niche lens through which light passes, said LED lighting system comprising:

a housing having air outflow openings formed therein;

an LED driver circuit board having a plurality of LEDs mounted thereon, circuitry components for driving said LEDs and a plurality of flow-through openings through which air may flow through the LED driver circuit board to carry heat away from the LEDs and circuitry;

a fan positioned below the LED driver circuit board; and a lens having a light diffusing region for diffusing light from the LEDs in advance of the niche lens and a plurality of air inflow openings formed in the lens;

wherein the fan is operative to circulate air inwardly though the inflow openings formed in the lens, then though the flow through openings formed in the LED driver circuit board and then out of the outflow openings formed in the housing.

2. A system according to claim 1 wherein the lens comprises a holographic light shaping diffuser.

3. An LED lighting assembly comprising an LED lighting system according to claim 1 in combination with a niche having a niche lens, wherein the LED lighting system is mounted within the niche and light from said at least one LED passes through the lens before passing though the niche lens.

4. A system according to claim 1 further comprising a transformer.

5. A system according to claim 1 wherein the LEDs comprise 12 2.5 Watt LEDs.

6. A method for replacing an existing LED light source or light bulb within an existing fixture or niche, said method comprising the steps of:

A) removing the existing LED light source or light bulb from the fixture or niche; and B) replacing the existing LED light source or light bulb with a system according to claim 1.

7. An LED lighting assembly according to claim 1 wherein the fan is positioned a spaced distance below the LED driver circuit board and wherein the space between the fan and the size of the flow through openings in the circuit board are such that the space functions as a low pressure air plenum when the fan is in operation.

* * * * *